US008696225B2

(12) United States Patent
Sekino et al.

(10) Patent No.: US 8,696,225 B2
(45) **Date of Patent: *Apr. 15, 2014**

(54) THERMAL PRINTER AND PRINTING DEVICE

(75) Inventors: Toshiharu Sekino, Izu (JP); Kousuke Takahashi, Sunto-gun (JP); Takeshi Hiyoshi, Mishima (JP); Kiyotaka Nihashi, Mishima (JP); Tsuyoshi Sanada, Ang Mo Kio (SG)

(73) Assignees: Toshiba Tec Kabushiki Kaisha, Tokyo (JP); NCR Corporation, Dayton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/547,287

(22) Filed: Jul. 12, 2012

(65) Prior Publication Data

US 2012/0274722 A1 Nov. 1, 2012

Related U.S. Application Data

(62) Division of application No. 13/022,987, filed on Feb. 8, 2011, now Pat. No. 8,231,291, and a division of application No. 11/681,914, filed on Mar. 5, 2007, now Pat. No. 7,914,218.

(30) Foreign Application Priority Data

| | | |
|---|---|---|
| Jun. 29, 2006 | (JP) | 2006-178944 |
| Jun. 29, 2006 | (JP) | 2006-178948 |
| Jun. 29, 2006 | (JP) | 2006-178957 |
| Jul. 7, 2006 | (JP) | 2006-188502 |
| Jan. 24, 2007 | (JP) | 2007-014112 |

(51) Int. Cl.
*B41J 29/13* (2006.01)

(52) U.S. Cl.
USPC ..... 400/693; 400/120.17; 400/663; 400/691; 347/198; 347/222

(58) Field of Classification Search
None
See application file for complete search history.

(56) References Cited

U.S. PATENT DOCUMENTS

| | | | |
|---|---|---|---|
| 4,729,681 | A | 3/1988 | Moser |
| 4,895,231 | A | 1/1990 | Yamaguchi et al. |

(Continued)

FOREIGN PATENT DOCUMENTS

| | | |
|---|---|---|
| EP | 61242863 | 10/1986 |
| EP | 1108556 | 6/2001 |

(Continued)

OTHER PUBLICATIONS

U.S. Office Action dated Apr. 6, 2009 corresponding to U.S. Appl. No. 11/681,914, filed Mar. 5, 2007.

(Continued)

*Primary Examiner* — Jill Culler
(74) *Attorney, Agent, or Firm* — Amin, Turocy & Watson, LLP

(57) ABSTRACT

According to an aspect of the present invention, a thermal printer includes a housing in which a space is formed, printing means disposed in the housing, a cover disposed in the housing and which comes into contact with and separates from the housing when rotated, thereby opening and closing the space, urging means for urging the cover in a direction away from the housing, an engaging part which is disposed in the housing and which prevents the movement of the cover in a direction away from the housing when engaged with the cover, a pressed part which is disposed rotatably in the cover and which moves the engaging part when pressed, thereby releasing engagement between the cover and the engaging part, and elastic means arranged to urge the pressed part in a direction away from the engaging part.

4 Claims, 11 Drawing Sheets

(56) References Cited

U.S. PATENT DOCUMENTS

| | | | | |
|---|---|---|---|---|
| 4,909,645 | A | 3/1990 | Sudo et al. | |
| 5,672,020 | A | 9/1997 | Leonard et al. | |
| 6,113,292 | A | 9/2000 | Unno et al. | |
| 6,118,469 | A | 9/2000 | Hosomi | |
| 6,155,730 | A | 12/2000 | Nakayama et al. | |
| 6,155,731 | A | 12/2000 | Bertalan et al. | |
| 6,267,520 | B1 | 7/2001 | Unno et al. | |
| 6,406,200 | B2 | 6/2002 | Mahoney | |
| 6,508,600 | B1 | 1/2003 | Nonaka | |
| 6,609,844 | B1 | 8/2003 | Petteruti et al. | |
| 6,759,366 | B2 | 7/2004 | Beckerdite et al. | |
| 6,784,906 | B2 | 8/2004 | Long et al. | |
| 7,710,442 | B2 * | 5/2010 | Lyons et al. | 347/171 |
| 2003/0002908 | A1 | 1/2003 | Hirabayashi et al. | |
| 2003/0118390 | A1 | 6/2003 | Yamada et al. | |
| 2004/0119808 | A1 | 6/2004 | Mori | |
| 2007/0211132 | A1 * | 9/2007 | Lyons et al. | 347/190 |
| 2009/0185021 | A9 * | 7/2009 | Lyons et al. | 347/190 |

FOREIGN PATENT DOCUMENTS

| | | |
|---|---|---|
| EP | 1862322 | 12/2007 |
| JP | 58008668 | 1/1983 |
| JP | 61003765 | 1/1986 |
| JP | 03051149 | 3/1991 |
| JP | 4339685 1 | 11/1992 |
| JP | 06024082 | 2/1994 |
| JP | 09233256 | 9/1997 |
| JP | 09301556 | 11/1997 |
| JP | 10076713 | 3/1998 |
| JP | 10114091 | 5/1998 |
| JP | 10235909 | 9/1998 |
| JP | 11005320 | 1/1999 |
| JP | 11286147 | 10/1999 |
| JP | 2000118060 | 4/2000 |
| JP | 2001096839 | 4/2001 |
| JP | 2001179926 | 7/2001 |
| JP | 2001199095 | 7/2001 |
| JP | 2002040614 | 2/2002 |
| JP | 2002-144611 | 5/2002 |
| JP | 2003257395 | 9/2003 |
| JP | 2004195805 | 7/2004 |
| JP | 2005070309 | 3/2005 |
| JP | 2007076154 | 3/2007 |
| WO | 2005047006 | 5/2005 |

OTHER PUBLICATIONS

U.S. Office Action dated Dec. 11, 2009 corresponding to U.S. Appl. No. 11/681,914, filed Mar. 5, 2007.

Japanese Office Action dated May 20, 2008 corresponding to U.S. Appl. No. 11/681,914, filed Mar. 5, 2007.

Japanese Office Action dated Jul. 8, 2008 corresponding to U.S. Appl. No. 11/681,914, filed Mar. 5, 2007.

Japanese Office Action dated Jan. 6, 2009 corresponding to U.S. Appl. No. 11/681,914, filed Mar. 5, 2007.

Partial European Search Report for EP 07108845 dated Feb. 7, 2008 corresponding to U.S. Appl. No. 11/681,914, filed Mar. 5, 2007.

European Search Report for EP 07108845 dated Jan. 19, 2009 corresponding to U.S. Appl. No. 11/681,914, filed Mar. 5, 2007.

Office Action dated Oct. 5, 2012 for U.S. Appl. No. 13/547,277, 35 pages.

Office Action dated Sep. 17, 2012 for U.S. Appl. No. 13/547,292, 20 pages.

Office Action dated Dec. 7, 2012 for U.S. Appl. No. 13/535,627, 29 pages.

Office Action dated Mar. 4, 2013 for U.S. Appl. No. 13/547,277, 11 pages.

Office Action dated Mar. 4, 2013 for U.S. Appl. No. 13/547,292, 15 pages.

Office Action dated Nov. 1, 2013 for U.S. Appl. No. 13/547,292, 20 pages.

Office Action dated Nov. 1, 2013 for U.S. Appl. No. 13/547,277, 12 pages.

* cited by examiner

THERMAL PRINTER AND PRINTING DEVICE

CROSS-REFERENCE TO RELATED APPLICATIONS

This application is a Division of application Ser. No. 13/022,987 filed Feb. 8, 2011, which is a Division of application Ser. No. 11/681,914 filed Mar. 5, 2007, the entire contents of both of which are hereby incorporated herein by reference.

This application is based upon and claims the benefit of priority from prior Japanese Patent Applications No. 2006-178944, filed Jun. 29, 2006; No. 2006-178948, filed Jun. 29, 2006; No. 2006-178957, filed Jun. 29, 2006; No. 2006-188502, filed Jul. 7, 2006; and No. 2007-014112, filed Jan. 24, 2007, the entire contents of all of which are incorporated herein by reference.

BACKGROUND OF THE INVENTION

1. Field of the Invention

The present invention relates to a thermal printer mounted on, e.g., a register, and a printing device.

2. Description of the Related Art

There has been known a thermal printer mounted on, e.g., a register or the like, to print various pieces of information in a receipt made of thermosensitive paper. Normally, for example, as described in Jpn. Pat. Appln. KOKAI Publication No. 11-286147, the thermal printer includes a thermal head for heating the thermosensitive paper and a platen roller for pressing the thermosensitive paper to the thermal head.

In such a thermal printer, when there is no more thermosensitive paper, a user must open a cover to supply new thermosensitive paper. Accordingly, a recent thermal printer may include a release button for easily opening a cover by a single action.

However, the conventional thermal printer has used a coil spring to return the pressed release button to its original position. Thus, a space must be provided to receive the coil spring in the cover, which has caused enlargement of the thermal printer. An object of the present invention to provide a compact thermal printer which enables easy opening of a cover by a single action.

In the above thermal printer, the thermosensitive paper passes between the thermal head and a platen, and printing is carried out on the thermosensitive paper by heat added to the thermal head. The thermosensitive paper is normally wound into a roll shape, and an opening/closing cap in an upper part of the casing must be opened when the thermosensitive paper is replaced.

The following problem has occurred in the above thermal printer. That is, the thermal head is disposed on the casing side, the platen is disposed on the cap side, and the thermal head and the platen normally come into contact with each other when pressed. Consequently, when the cap is opened/closed, the platen interferes with the casing side. Thus, a complex operation of opening/closing the opening/closing cap after shifting it in a direction away from the thermal head, or the like is necessary.

It is therefore an object of the present invention to provide a thermal printer which can open an opening/closing cap by an easy operation when thermosensitive paper is replaced.

As described in U.S. Pat. No. 3,118,469, there has been known a thermal printer in which a cover is fixed to a printer main body to be rotated and opened/closed, a thermal head is disposed on a printer main body side, and a platen roller is disposed on a cover side. In this case, to obtain a desired conveying force and desired printing pressure, the thermal head is pressed to the platen roller in a closed state. In this thermal printer, the printer main body and the cover are engaged with each other by a locking mechanism to maintain the closed state, and the engagement of the locking member is released to move the cover away from the printer main body, thereby setting an opened state. However, in the thermal printer of this configuration, as the thermal printer is pressed to the platen roller in the closed state to generate a frictional force, even if the engagement of the locking member is released, this frictional force produces resistance, making opening/closing difficult. It is therefore an object of the present invention to provide a thermal printer which enables easy and smooth opening/closing.

There has been known a printing device which includes a first printing part positioned on a sheet conveying-direction downstream side in a sheet conveying path and a second printing part positioned on a sheet conveying-direction upstream side in a device main body, and performs printing on both surfaces of a sheet by the first and second printing parts.

For example, as described in U.S. Pat. No. 6,784,906, the first printing part includes a first thermal head as a printing head, and a first platen roller arranged to face the first thermal head via the sheet conveying path and to convey the sheet. The second printing part includes a second thermal head as a printing head, and a second platen roller arranged to face the second thermal head via the sheet conveying path and to convey the sheet.

An opening/closing member is disposed in the device main body, and sheets are replenished by opening this opening/closing member. The first platen roller of the first printing part and the second thermal head of the second printing part are fixed to the opening/closing member. By closing the opening/closing member, the first thermal head is pressed to the first platen roller, and the second thermal head is pressed to the second platen roller. The first and second thermal heads are pressed by spring forces of first and second spring members.

However, as pressing directions of the first and second thermal heads to the first and second platen rollers are reverse to each other, there has conventionally been a problem that their pressing forces affect each other, and it is difficult to set head loads of the first and second thermal heads on the first and second platen rollers to proper states, making it impossible to expect good printing.

An object of the present invention to provide a printing device which can properly obtain head loads of first and second printing heads on first and second platens.

BRIEF SUMMARY OF THE INVENTION

According to an aspect of the present invention, a thermal printer includes a housing in which a space is formed to receive thermosensitive paper; printing means disposed in the housing to print various pieces of information in the thermosensitive paper, a cover which is disposed in the housing and which comes into contact with and separates from the housing when rotated, thereby opening and closing the space, urging means for urging the cover in a direction away from the housing; an engaging part which is disposed in the housing and which prevents the movement of the cover in a direction away from the housing when engaged with the cover; a pressed part which is disposed in the cover and which moves the engaging part when pressed, thereby releasing engagement between the cover and the engaging part; a support shaft body disposed in a position away from the pressed part to rotatably support the pressed part; and elastic means arranged on a side opposed to the pressed part by using the support shaft body as a reference to urge the pressed part in a direction away from the engaging part.

According to this configuration, a cover of the thermal printer can be easily opened by a single action. Additionally, the thermal printer can be made compact.

According to an aspect of the present invention, a thermal printer includes a casing having a hollow part and an opening continuous from the hollow part disposed in its upper part, a thermal head disposed on one side of the casing to face the hollow part, a cap for opening/closing the opening by using a horizontal rotational shaft disposed on the other side of the casing as s rotational center, a supporting part disposed on the casing to support the rotary shaft so as to move to the other side of the casing, a platen roller disposed in the casing, positioned in the hollow part in a closed state of the opening, and arranged to face the thermal head, a thermosensitive paper conveying mechanism arranged in the hollow part to convey thermosensitive paper along a sheet conveying path and to supply the paper between the thermal head and the platen roller in a closed state of the cap, a locking part disposed in the cap, an opening/closing button fixed to one side of the casing and having a concave part opened downward, an insertion member having its base end disposed to rotate around the horizontal rotary shaft arranged on one side of the casing, its tip disposed to be inserted into/pulled from the concave part of the opening/closing button, and a locked part disposed in its middle position to be locked by the locking part, and an urging member for urging the locked part of the insertion member in a direction of locking it in the locking part. The concave part and the tip of the insertion member are formed into shapes so that by pressing the opening/closing button, the tip of the insertion member is moved to one side of the casing, and the locking between the locking part and the locked part is released against an urging force of the urging member.

According to this configuration, the opening/closing cap can be opened by a simple operation when the thermosensitive paper is replaced.

According to an aspect of the present invention, a thermal printer includes a printer main body, a cover fixed to the printer main body to rotate between closed and opened states; a platen roller disposed in the cover; a thermal head disposed in the printer main body, and arranged to face the platen roller in a closed state and to press the platen roller; a locking mechanism which engages and disengages the printer main body and the cover; and a linking member which links the thermal head with the locking mechanism, and retreats the thermal head from the platen roller with disengagement of the locking mechanism.

According to this configuration, because a linking member is provided, the thermal head is retreated from the platen roller with disengagement of the locking member. Thus, opening/closing is easy and smooth.

According to an aspect of the present invention, a printing device includes a device main body which includes an opening/closing member, a first printing head to print first both surface sides of a sheet, a first platen, a second printing head to print second surface sides of the sheet and a second platen which are arranged to face each other via a sheet conveying path in the device main body, and first and second spring members which elastically press the first and second printing heads to the first and second platens, wherein the first platen and the second printing head are fixed to the opening/closing member, and the first printing head and the second platen are fixed to the device main body side, and the first and second printing heads are arranged so that pressing directions of the first and second platens intersect each other.

According to this configuration, head loads of the first and second printing heads on the first and second platens can be properly obtained, and good printing can be carried out.

Objects and advantages of the invention will become apparent from the description, which follows, and may be learned by practice of the invention.

BRIEF DESCRIPTION OF THE SEVERAL VIEWS OF THE DRAWING

The accompanying drawings illustrate embodiments of the invention, and together with the general description given above and the detailed description given below, serve to explain the principles of the invention.

DETAILED DESCRIPTION OF THE, INVENTION

First Embodiment

A first embodiment of the present invention will be described below with reference to the accompanying drawings.

Figure 1:
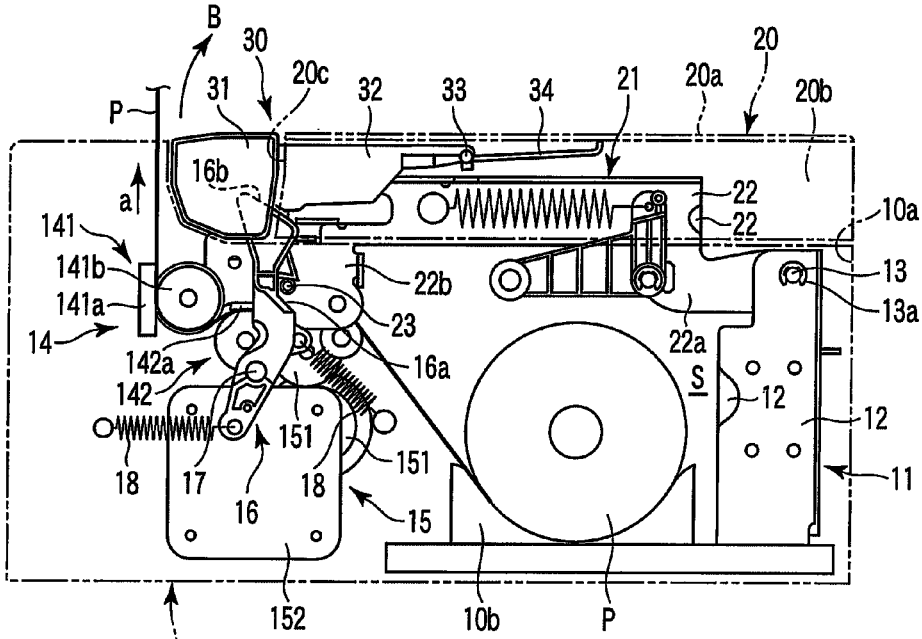
FIG. 1 is a schematic diagram of a thermal printer when a cover is closed according to a first embodiment of the present invention.
Figure 2:
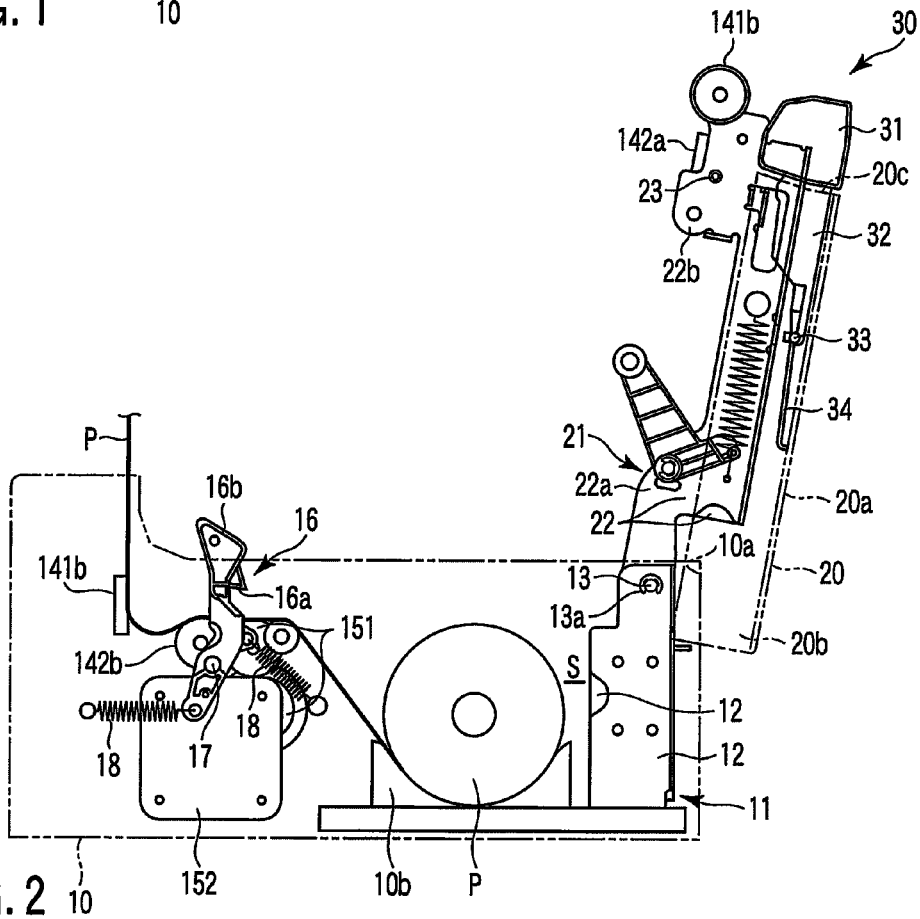
FIG. 2 is a schematic diagram of the thermal printer when the cover is opened according to the embodiment.

FIG. 1 is a schematic diagram of a thermal printer when a cover 20 is closed according to the first embodiment of the present invention, and FIG. 2 is a schematic diagram of the thermal printer when the cover is opened according to the embodiment. For example, the thermal printer of the embodiment is mounted on a register or the like to be used for printing a receipt. As shown in FIGS. 1 and 2, such a thermal printer includes a housing 10 as a main body casing, and a cover 20 for opening/closing an opening 10*a* of the housing 10.

The housing 10 has a rectangular box shape, and a housing frame 11 is arranged therein. The housing frame 11 includes two frame bodies 12 arranged on both sides of the housing 10, and a reception space (space) S is formed nearby to receive thermosensitive paper P. The thermosensitive paper P is wound in a roll to be placed on a base 10*b* fixed to a bottom wall of the housing 10. There is no particular limitation on types of thermosensitive paper. According to the embodiment, however, a type having thermosensitive layers on both first and second surfaces which are respectively a front and a back is used.

The frame bodies 12 extend from the bottom wall of the housing 10 to positions near the opening 10*a* of the housing 10; and a connecting shaft 13 is set in a predetermined position in parallel with the bottom wall of the housing 10. Each frame body 12 is formed into a plate shape, and fixed to the bottom wall of the housing 10 by screws or the like.

In the housing 10, a printing device 14 is disposed on a side opposed to the housing frame 11 to print various pieces of information on the thermosensitive paper P by using the reception space S as a reference. The printing device 14 includes a first printing unit 141 in charge of printing on the first surface which is the front of the thermosensitive paper P, and a second printing unit 142 in charge of printing on the second surface which is the back of the thermosensitive paper P.

The first printing unit 141 includes a first thermal head 141*a* fixed to the housing 10, and a first platen roller 141*b* fixed to the cover 20. The first thermal head 141*a* extends in parallel with the connecting shaft 13 to heat the first surface which is the front of the thermosensitive paper P in accordance with information from a controller (not shown). The first platen roller 141*b* extends in parallel with the connecting shaft 13, i.e., in parallel with the first thermal head 141*a*, to press the thermosensitive paper P to the first thermal head 141*a*.

The second printing unit 142 includes a second thermal head 142*a* fixed to the cover 20, and a second platen roller 142*b* fixed to the housing 10. The second thermal head 142*a* extends in parallel with the connecting shaft 13 to heat the second surface which is the back of the thermosensitive paper P in accordance with information from the controller (not shown). The second platen roller 142*b* extends in parallel with the connecting shaft 13, i.e., in parallel with the second thermal head 142*a*, to press the thermosensitive paper P to the second thermal head 142*a*.

Each of the first and second platen rollers 141*b*, 142*b* is rotated in a predetermined direction by a driving device 15, and conveys the thermosensitive paper P in an arrow direction a by using friction from a rubber film formed in the first surface which is a roller surface.

The driving device 15 includes a plurality of driving rollers 151 (only two are shown) for driving the first and second platen rollers 141*b*, 142*b*, and a stepping motor 152 for driving the driving rollers 151.

When the stepping motor 152 is operated, the plurality of driving rollers 151 are driven, and the first and second platen rollers 141*b*, 142*b* are rotated in predetermined directions. The thermosensitive paper P held between the thermal head 141*a* and the first platen roller 141*b* and between the second thermal head 142*a* and the second platen roller 142*b* is conveyed in the arrow direction a by friction from the first and second platen rollers 141*b*, 142*b*. At this time, the first and second thermal heads 141*a*, 142*a* heat the thermosensitive paper P to form characters or symbols in the first and second surfaces which are respectively a front and a back.

In the housing 10, a rodlike hook 16 is disposed in a place which is opposed to the connecting shaft 13 and on the right as seen by the user (before paper surface in FIG. 1) by using the reception space S as a reference.

Figure 3:
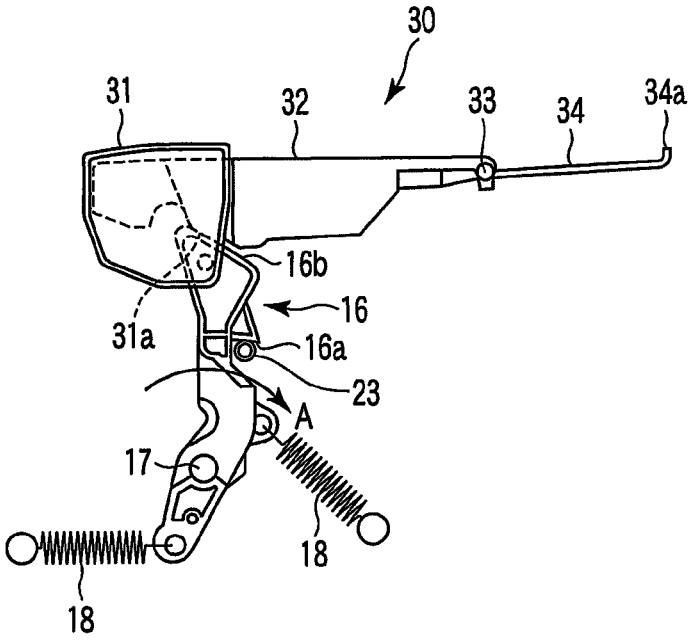
FIG. 3 is a front diagram showing a release button and a hook according to the embodiment.

FIG. 3 is a front diagram of the release button 30 and the hook 16 according to the embodiment.

As shown in FIG. 3, the hook 16 is rotatably supported by a shaft body 17 fixed to the housing 10, and includes a notch 16*a* formed in a place opposed to the connecting shaft 13 to be engaged with an engaging shaft body 23 (described below) arranged in the cover frame 21.

In the hook 16, spring coils 18 are connected to places opposed to each other around the shaft body 17. These spring coils 18 are connected to the housing 10 to urge the hook 16 in an arrow direction A.

A pressed surface 16*b* pressed by a pressing surface 31*a* formed in a button main body 31 (described below) is formed in an upper part of the hook 16, i.e., a place opposed to the cover 20 in a state in which the cover 20 closes the reception space S of the housing 10. The pressed surface 16*b* is inclined to approach the bottom wall of the housing 10 as it approaches the connecting shaft 13.

As shown in FIGS. 1, 2, the cover 20 includes upper and side walls 20*a* and 20*b*, and has a U sectional shape. The cover frame 21 is fixed in an inner surface of the cover 20, i.e., a place facing the housing 10 in a state in which the cover 20 closes the reception space S of the housing 10.

The cover frame 21 includes two frame bodies 22 arranged on both sides of the cover 20. Each frame body 22 is formed into a plate shape, and fixed to the inner surface of the cover 20 by screws or the like.

The frame bodies 22 include first and second engaging plate parts 22*a* and 22*b*. The first engaging plate part 22*a* extends into the housing 10, and the connecting shaft 13 is rotatably connected to its predetermined place. Accordingly, the cover 20 is supported to rotate around the connecting shaft 13 with respect to the housing 10. Springs 13*a* are disposed in both ends of the connecting shaft 13. These springs 13*a* urge the cover frame 21 in an arrow direction B of FIG. 2.

The second plate parts 22*b* extend in a direction away from the cover 20. Among these, in the second engaging plate part 22*b* of the frame body 22 arranged on the right as seen by the user, an engaging shaft body 23 is disposed to be engaged with the hook 16. The engaging shaft body 23 extends in parallel with the connecting shaft 13 to reach the vicinity of an inner surface of the side wall of the housing 10.

The release button 30 is arranged in a place of the cover 20 which is the right side as seen by the user. As shown in FIG. 3, the release button 30 includes a button main body (pressed part) 31, an arm 32, a support shaft body 33, and a leaf spring 34. These are formed by integral molding, and the button main body 31, the support shaft body 33 and the leaf spring 34 among them are linearly arrayed.

As shown in FIGS. 1, 2, the button main body 31 is arranged in the notch 20*c* formed in the cover 20. In its lower part, i.e., a place facing the housing 10 in the state in which the cover 20 closes the reception space S of the housing 10, as shown in FIG. 3, a pressing surface 31*a* for pressing the pressed surface 16*b* of the hook 16 is formed. As in the case of the pressed surface 16*b*, the pressing surface 31*a* is inclined to approach the bottom surface of the housing 10 as it approaches the connecting shaft 13.

As shown in FIG. 3, the arm 32 is arranged in the cover 20 to extend from the side part of the button main body 31 toward the connecting shaft 13. The support shaft body 33 is connected to an end of the arm 32 opposed to the button main body 31, and supported to rotate around an axis parallel to the connecting shaft 13 by support means (not shown) disposed in the cover 20.

The leaf spring 34 extends from a place of the support shaft body 33 opposed to the arm 32 toward the connecting shaft 13. In a place nearest the connecting shaft 13, an abutment part 34*a* is formed to extend toward an upper wall 20*a* of the cover 20. The abutment part 34*a* always elastically abuts the upper wall 20*a*. Accordingly, the release button 30 is always urged to the upper side by the leaf spring 34.

Opening Operation of Cover 20

Figure 4:
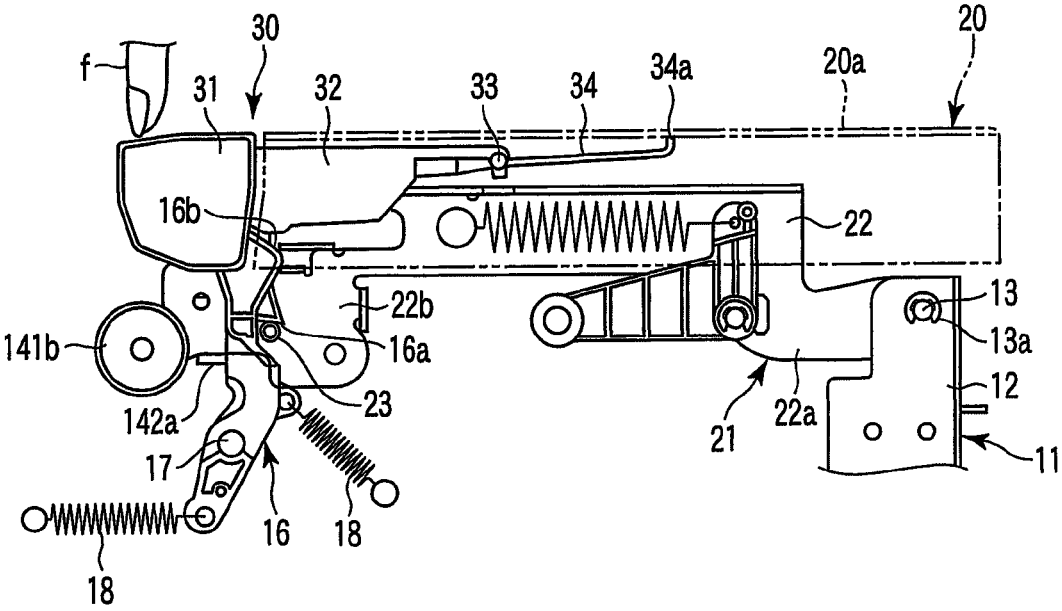
FIG. 4 is a schematic diagram showing a state when a button main body is not pressed according to the embodiment.
Figure 5:
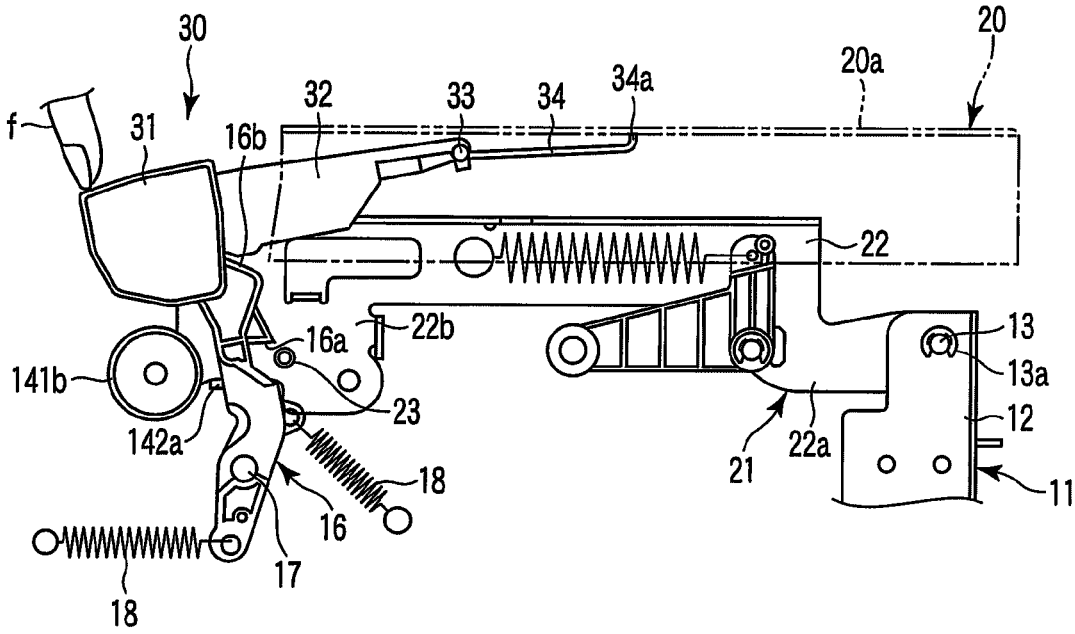
FIG. 5 is a schematic diagram showing a state the instant engagement between the hook and an engaging shaft body is released according to the embodiment.
Figure 6:
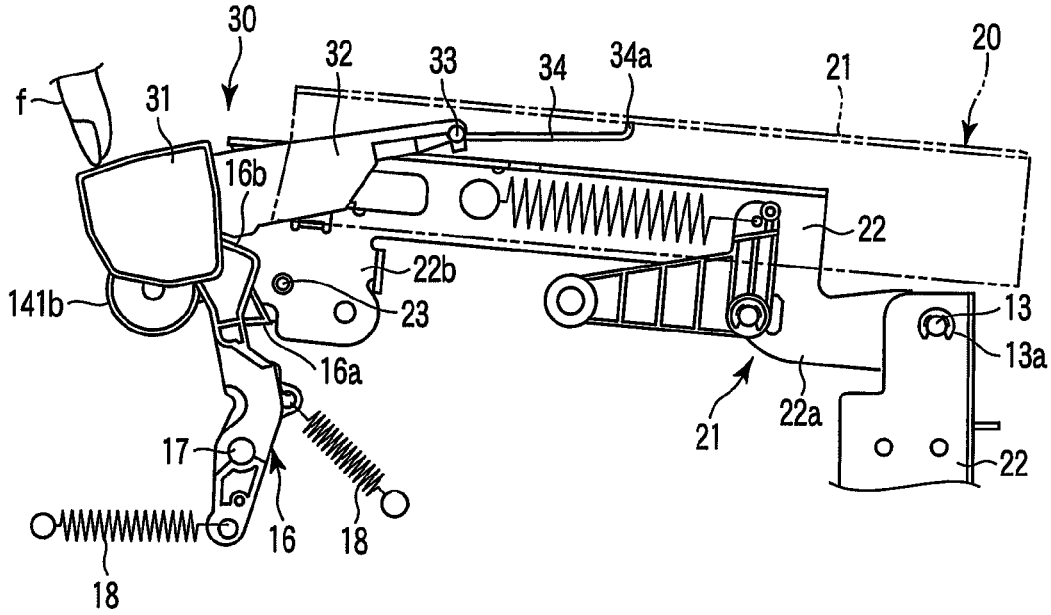
FIG. 6 is a schematic diagram showing a state when the cover is raised from a housing according to the embodiment.

FIG. 4 is a schematic diagram showing a state in which the button main body 31 is not pressed according to the embodiment, FIG. 5 is a schematic diagram showing a state the instant engagement between the hook 16 and the engaging shaft body 23 is released according to the embodiment, and FIG. 6 is a schematic diagram showing a state when the cover 20 is raised from the cover 10 according to the embodiment.

When there is no more thermosensitive paper P, the button main body 31 of the release button 30 is pressed downward by a finger f of the user. FIG. 4 shows a state immediately before the button main body 31 is pressed.

When the button main body 31 is pressed, the release button 30 rotates around the support shaft body 33, and the pressing surface 31*a* formed in the lower part of the button main body 31 abuts the pressed surface 16*b* formed in the upper part of the hook 16.

When the button main body 31 is pressed more from this state, the hook 16 rotates around the shaft body 17 by pressing from the pressing surface 31*a* of the button main body 31, and the engaging shaft body 23 formed in the cover frame 21 is removed from the notch 16*a* of the hook 16. FIG. 5 shows a state the instant the engaging shaft body 23 is removed from the notch 16*a* of the hook 16.

With disengagement between the hook 16 and the engaging shaft body 23, the cover 20 is urged by the spring 13*a* arranged in the connecting shaft 13 to rotate around the same, thereby raising the cover 20 slightly. FIG. 6 shows a state when the cover 20 is slightly raised.

At this time, the button main body 31 of the release button 30 is still pressed by the finger f of the user. Accordingly, positions of the button main body 31 and the hook 16 are not changed while the cover 20 and the cover frame 21 are raised. Thus, the engaging shaft body 23 disposed in the cover frame 21 is raised together with the cover 20 to move to a position higher than the notch 16*a* of the hook 16. As a result, even when the pressing of the button main body 31 is released, the engaging shaft body 23 and the hook 16 are not engaged with each other again.

When the pressing of the button main body 31 is released, the release button 30 is urged by the leaf spring 34 to rotate around the support shaft body 33, and the button main body 31 is returned to its original position. After the button main body 31 is returned to the original position, the hook 16 is urged by the spring 13*a* to rotate around the support shaft body 33, and to be returned to its initial position.

As described above, according to the embodiment, the cover 20 is easily opened only by pressing the button main body 31 of the release button 30.

Furthermore, when the pressing of the release button 30, the release button 30 is returned to its original position by urging from the leaf spring 34.

Effects of Embodiment

According to the embodiment, the leaf spring 34 is used for returning the release button 30 pressed by the user to its original position. Thus, the thermal computer is made compact as no reception space as large as the conventional coil spring is necessary.

According to the embodiment, the button main body 31, the support shaft body 33, the leaf spring 34, and the abutment part 34*a* constituting the release button 30 are linearly arrayed. Thus, even when a large force is applied to the button main body 31, the release button 30 is not twisted, and accordingly inclination of the button main body 31 is prevented.

The present invention is not limited to the thermal printer, but it can be applied to any devices as long as they include covers repeatedly opened/closed with a high frequency.

Second Embodiment

Figure 7:
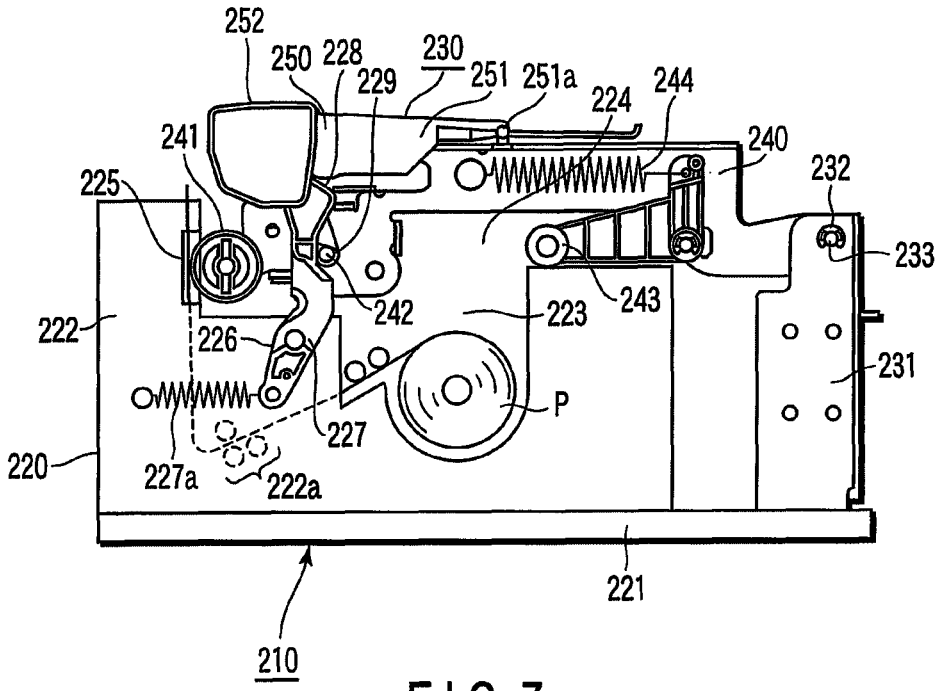
FIG. 7 is a longitudinal sectional diagram schematically showing a thermal printer according to a second embodiment of the present invention.
Figure 8:
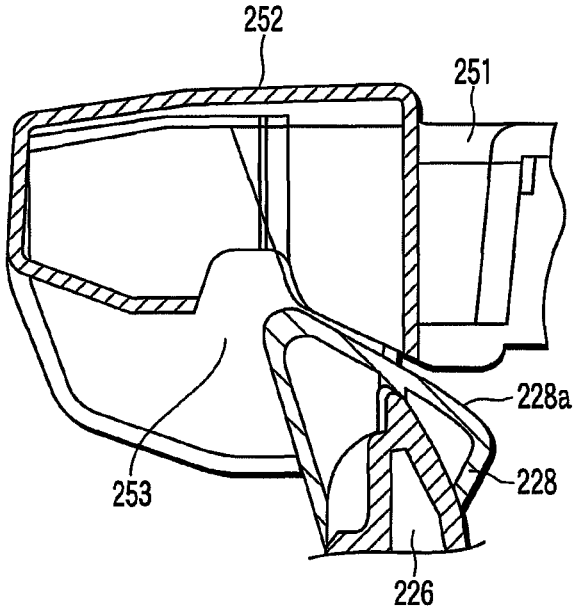
FIG. 8 is a longitudinal sectional diagram showing a main part of an opening/closing cap of the thermal printer.
Figure 9:
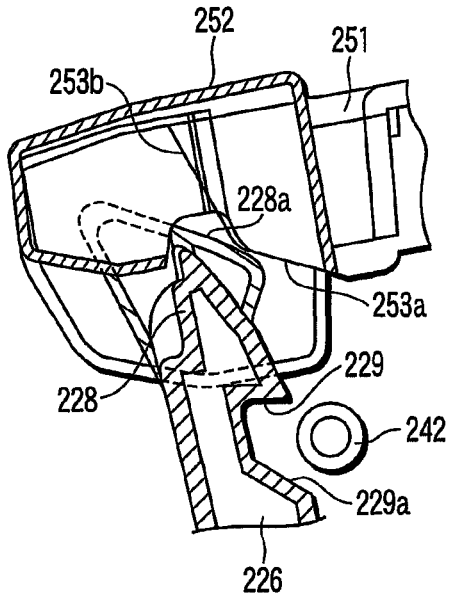
FIG. 9 is a longitudinal sectional diagram showing the main part of the opening/closing cap of the thermal printer.
Figure 10:
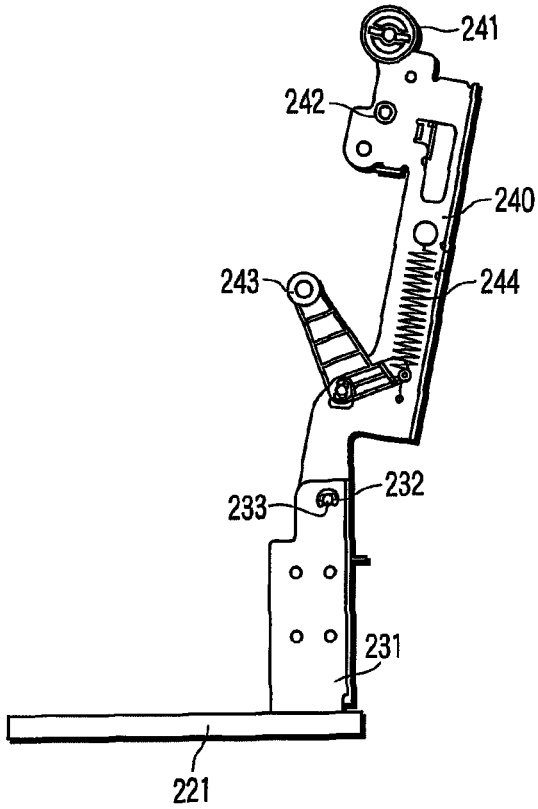
FIG. 10 is a longitudinal sectional diagram schematically showing an opened state of the opening/closing cap of the thermal printer.

FIG. 7 is a longitudinal sectional diagram schematically showing a thermal printer 210 according to a second embodiment of the present invention, FIG. 8 is a longitudinal sectional diagram showing a main section of an opening/closing cap of the thermal printer 210, FIG. 9 is a longitudinal sectional diagram showing the main section of the opening/closing cap of the thermal printer 210, and FIG. 10 is a longitudinal diagram schematically showing a state in which the opening/closing cap of the thermal printer 210 is opened. In the drawings, P denotes thermosensitive paper. In each of FIGS. 7 to 10, a left side is equivalent to one side of a casing main body 220, and a right side is equivalent to the other side of the casing main body 220.

The thermal printer 210 includes the casing main body 220 for housing each mechanism, and an opening/closing mechanism 230 disposed to be opened/closed with respect to the casing main body 220.

The casing main body 220 includes a base part 221 made of a resin. On the base part 221, a main body part 222 is disposed to receive various devices such as a thermosensitive paper conveying mechanism 222*a*, and a hollow part 223 is formed therein. The hollow part 223 is opened upward as shown, and an opening 224 is formed therein.

A thermal head 225 is fixed to an inner wall surface of one side of the main body part 222 to be exposed to the hollow part 223. On a left side (shown) of the main body part 222, an insertion member 226 (engaging part) is disposed to that its base end 227 can rotate around a horizontal rotary shaft (support shaft body). Additionally, a tip 228 of the insertion member 226 is disposed to inserted into/pulled from a concave part 253 of an opening/closing button 252 described below. In a middle position of the insertion member 226, a locked part 229 is disposed to be locked by a pin 242 described below. A guide part 229*a* is formed in a lower part of the locked part 229, and into a shape so that it abuts the pin 242 for guiding to the locked part 229 side.

The pin 242 and the locked part 229 are engaged with each other in a closed state of the opening/closing cap 250. A tensile spring (urging member) 227*a* is connected to the base end 227, and the tip 228 is urged to the right side to maintain the engagement between the pin 242 and the locked part 229.

A slope 228*a* (see FIG. 8) is formed in the tip 228 to descend from the left side of the casing main body 220 to the right side, and to slide with a slope 253*a* of a concave part 253 of the opening/closing button 252 described below.

The opening/closing mechanism 230 includes a support part 231 erected in the base 221, a horizontal rotary shaft 233 fixed to a support hole 232 formed in the support part 231, a sheet cover frame 240 rotated around the rotary shaft 233, and an opening/closing cap 250 fixed to the sheet cover frame 240 to cover the hollow part 223. The support hole 232 has an elliptical shape in which a long axis is horizontal, and is formed so that the rotary shaft 233 can move in a horizontal direction.

A platen roller 241 is disposed on a tip side of the sheet cover frame 240, and is pressed to the thermal head 225 in a closed state of the opening/closing mechanism 230. The sheet cover frame 240 further includes a pin (locking part) 242 for locking the locked part 229 of the insertion member 226. In a middle part of the sheet cover frame 240, an abutment member 243 is disposed to abut the main body part 222, and the sheet cover frame 240 is urged in an opening direction by a spring member 244.

The opening/closing cap 250 includes a cap body 251 (cover), and a base end side of the cap body 251 is fixed to the sheet cover frame 240 to swing up and down via a swing shaft 251*a*. The opening/closing button 252 is fixed to a tip side of the cap body 251 equivalent to one side of the casing main body 220. As shown in FIG. 8, a bottom surface of the opening/closing button 252 is opened, and a concave part 253 into which the insertion member 226 can be inserted is disposed.

The concave part 253 includes a slope 253*a* in which a slope 228*a* disposed in the tip 228 of the insertion member 226 is formed to slide, and a slope 253*b* of a large inclination angle is formed to be continuous from an upper side of the slope 253*a*. Accordingly, for the concave part 253 and the tip 228 of the insertion member 226, the tip 228 can be moved to the left side by pressing the opening/closing button 252 downward, and the locking between the pin 242 and the locked part 229 can be released against an urging force of the tensile spring 227*a*.

In the thermal printer 210 thus configured, the thermosensitive paper P is replaced as follows. That is, by pressing downward the opening/closing button 252 of the opening/closing mechanism 230, the slope 253*a* of the concave part 253 abuts the slope 228*a* of the insertion member 226 to move the tip 228 of the insertion member 226 to the left in the drawing. Accordingly, as shown in FIG. 9, the locking between the pin 242 and the locked part 229 is released.

Even when the locking is released, the slope 228*a* of the insertion member 226 presses the slope 253*a* of the concave part 253 to the right side. Thus, the sheet cover frame 240 is urged to the right side as a whole. On the other hand, as the support hole 232 has an elliptical shape, the rotary shaft 233 of the sheet cover frame 240 is moved rightward. The resin-made base 221 is distorted to separate the thermal head 225 from the platen roller 241, and thus interference of the platen roller 241 with the main body part 222 is prevented when the sheet cover frame 240 is opened.

As the abutment member 243 of the sheet cover frame 240 is pressed to the main body part 222, the sheet cover frame 240 is automatically opened.

After replacement of the thermosensitive paper P, when the sheet cover frame 240 is closed, the abutment member 243 first abuts the main body part 222 to slowly extent the spring member 244. Accordingly, the sheet cover frame 240 is slowly closed.

When the opening/closing button 252 is pushed in, the pin 242 abuts the guide part 229*a* to guide it. Then, the pin 242 is engaged with the engaged part 229, and the platen roller 241 abuts the thermal head 225.

As described above, according to the thermal printer 210 of the embodiment, when the thermosensitive paper P is replaced, the opening/closing cap 250 can be opened/closed only by an easy operation of pressing the opening/closing button 252, and interference of the platen roller 241 with the other members is prevented.

Figure 11:
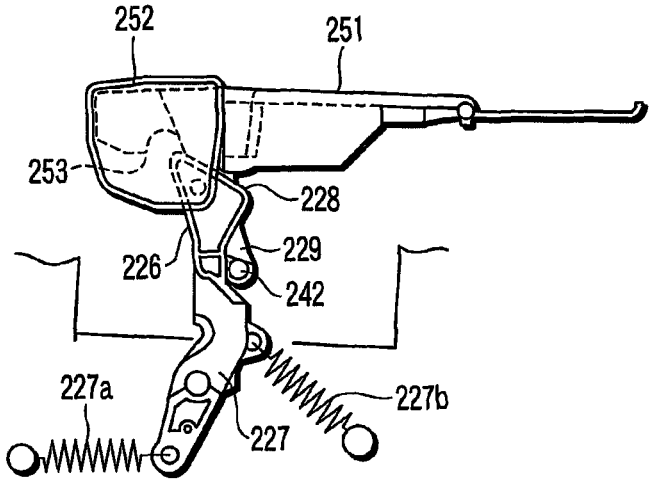
FIG. 11 is a side diagram showing a modified example of the thermal printer.

The present invention is not limited to the embodiment. For example, as shown in FIG. 11, a tensile spring (urging member) 227*b* may be added to urge the tip 228 for the insertion member 226 more strongly to the right. Moreover, needless to say, various changes can be made without departing from a gist of the invention.

Third Embodiment

A thermal printer 310 according to a third embodiment of the present invention will be described below by referring to FIGS. 12 to 15.

Figure 12:
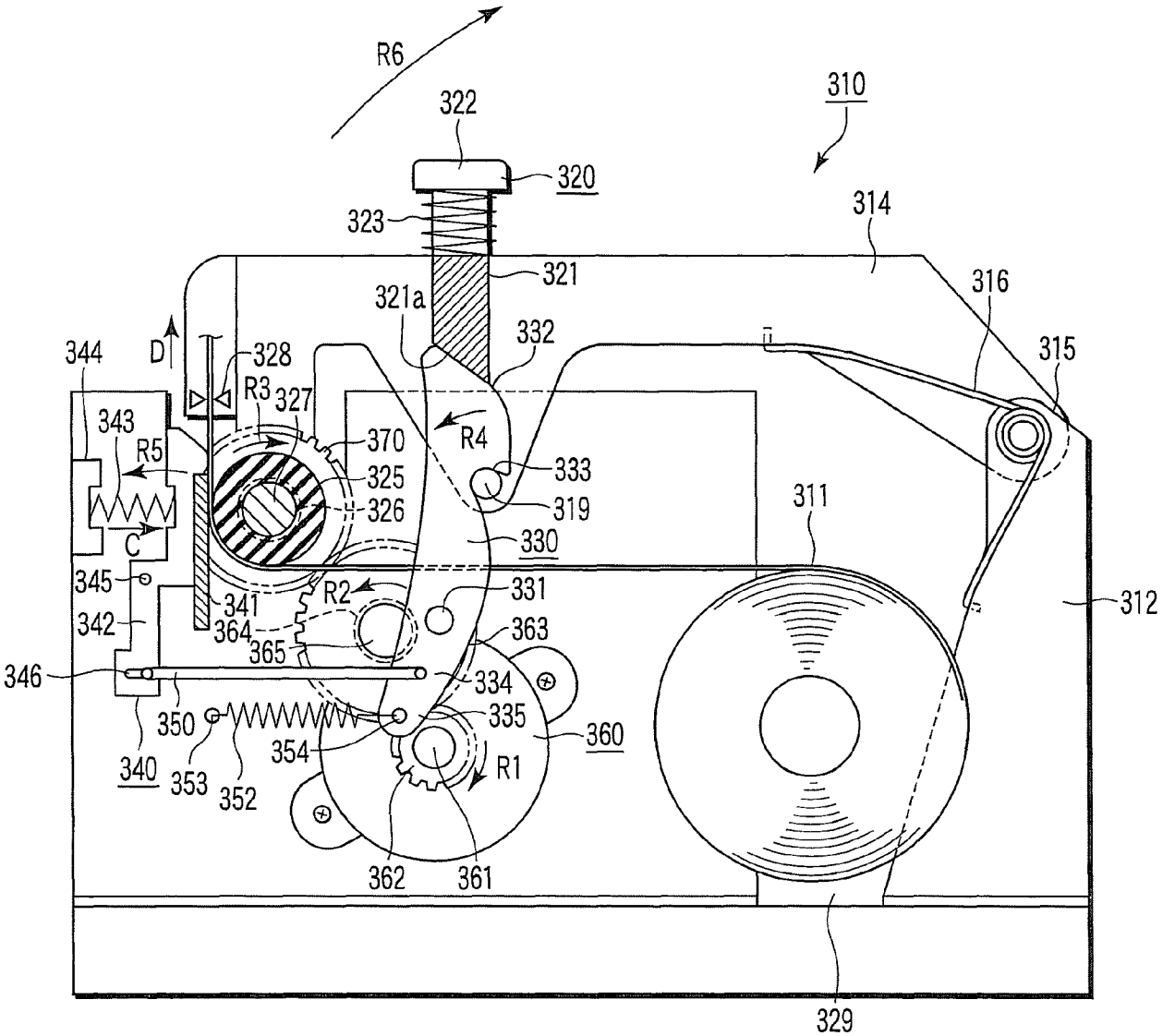
FIG. 12 is a side diagram schematically showing the inside of a thermal printer in a closed state according to a third embodiment of the present invention.

FIG. 12 schematically shows the inside of the thermal printer 310. This thermal printer 310 has a function of printing in a thermal sheet 311, and it can be used for, for example, a cash register or the like.

The thermal printer 310 includes a printer main body 312 having its upper part opened, and a cover 314 to cover this opening. The cover 314 is fixed to a hinge part 312 formed in an upper part of the printer main body 312 to rotate and to be opened/closed.

The hinge part 315 includes a twist spring 316 disposed as an urging member. One end of the twist spring 316 abuts the printer main body 312, and the other end abuts the cover 314. The cover 314 is urged to the printer main body 312 in an opening direction by this twist spring 316.

An engaging pin 319 is disposed on the side of the cover 314. The engaging pin 319 is formed into a cylindrical shape in which a shaft center horizontally extends, and positioned in an engaging concave part 333 of an engaging pawl 330 described below in a closed state to be engaged with the engaging concave part 333.

An operation member 320 is disposed in an upper part of the cover 314 to rotate the engaging pawl 330. The operation member 320 includes a shaft part 321 inserted into a hole formed in an upper surface of the cover 314. In a tip of the shaft part 321, a slope 321*a* is formed to abut the engaging pawl 330. A dislike button part 322 having a diameter larger than the hole is connected to an upper part of the shaft part 321. An elastic body 323 is disposed between the button part 322 and the upper surface of the cover 314. For example, this elastic body 323 is a roll spring arranged around the shaft part 321 to press the operation member 320 upward. When an operator applies a downward certain or greater force to the button part 322, this elastic body 323 is contracted, and the operation member 320 is linearly moved downward. When the force is released, the operation member 320 is raised to its original position by an elastic restoring force of the elastic body 323.

A platen roller 325 is disposed in a front end of the cover 314. The platen roller 325 is integrally fixed to a rotatable platen shaft 327 supported on the left and right sides of the cover 314 via the shaft part 326 to extend in a horizontal direction. The platen roller 325 is formed into a cylindrical shape to extend in a horizontal direction, and can be rotated integrally with the platen shaft 327. This platen roller 325 is made of an elastic material such as nitrile rubber (NBR) having rubber elasticity and a friction factor larger than that of a metal. The platen roller 325 is arranged to face the thermal head 341 described below sandwiching the thermal sheet 311 in a closed state.

A cutter mechanism 328 is disposed above the platen roller 325 to cut the thermal sheet 311 in the closed state.

A sheet reception part 329 is disposed in a rear part in the printer main body 312 to receive the thermal sheet 311. The thermal sheet 311 includes a base sheet and a thermosensitive layer formed in one surface (e.g., first surface which is a front) of the base sheet. For example, the thermosensitive paper is made of a material which is colored as desired such as black or red when heated to a predetermined temperature or more. This thermal sheet 311 is arranged in the sheet reception part 329 in a state of being rolled as shown in FIG. 12 so that the thermosensitive layer can face outward.

The engaging pawl 330 that constitutes one example of a locking mechanism is fixed to the side part of the printer main body 312 via a first rotary shaft 331. The engaging pawl 330 is configured to rotate around the first rotary shaft 31. A slope 332 is formed in an upper end of the engaging pawl 330. An engaging concave part 333 is formed in an upper rear part of the engaging pawl 330 to be engaged with the engaging pin 319. One end of a linking member 350 as an example of a linking member is fixed to a side opposed to the engaging concave part 333 around the first rotary shaft 331, i.e., a lower part 334. One end of the elastic member 352 is fixed to a lower end of the engaging pawl 330.

A thermal head unit 340 is disposed in a front end of the printer main body 312. The thermal head unit 340 includes a thermal head 341, a heat sink 342, urging means 343, and a spring washer 344. The heat sink 342 fixed to the printer main body 312 to rotate around a second rotary shaft 345 has a function as a heat discharge structure. The thermal head 341 is fixed to the heat sink 342, and pressed toward the platen roller 325 on an upper end side of the second rotary shaft 345.

In an end of the heat sink 342 lower than the second rotary shaft 345, a long-hole shaped attaching part 346 is formed to fix the linking member 350. An end of the linking member 350 is rotatably fixed to this attaching part 346 with a clearance. Through this clearance, the engaging pawl 330 is not rotated unless a certain or greater force is applied to the button part 322. Accordingly, constant printing pressure is normally secured.

The thermal head 341 is arranged in a backward and longitudinal (nearly vertical) posture. The thermal head 341 is arranged to come into contact with the thermosensitive layer of the thermal sheet 311 and to face the platen roller 325 sandwiching the thermal sheet 311 in a closed state.

The urging means 343 is disposed on a backside of the heat sink 342, i.e., a side opposed to the thermal head 341. An example of the urging means 343 is a spring member such as a compression spring or a twist spring, and arranged between the spring washer 343 disposed in the front end of the printer main body 312 and the heat sink 342 in a compressed state. The urging means 343 presses the thermal head 341 toward the platen roller 325 in an arrow direction C of FIG. 12.

The linking member 350 for connecting the heat sink 342 to the engaging pawl 330 is formed into a rod shape. One end of the linking member 350 is fixed to a lower part of the engaging pawl 330, and the other end is fixed to the attaching part 346 of the heat sink 342 with a clearance.

For example, the elastic member 352 is made of a spring member to be elongated/contracted. One end 354 of the elastic member 352 is connected to the printer main body 312, and the other end 353 is connected to a lower end 335 of the engaging pawl 330. When the button part 322 is pressed by a certain or greater force, the engaging pawl 330 is inclined and the elastic member 352 is elongated. The elastic member 352 is contracted when the force applied to the button part 322 is removed, and the lower end 335 of the engaging pawl 330 is pulled by its elastic restoring force, whereby the inclination of the engaging pawl 330 is regulated.

A motor 360 as a driving source is fixed to the front of the sheet reception part 329 in the printer main body 312 via the attaching part. For example, the motor 360 is a stepping motor to be rotated forward/backward, and enables reverse feed printing. The motor 360 includes an output shaft 361 and an output gear 362 rotated integrally with the output shaft 361.

A drive gear 363 is disposed in front and upper parts of the motor 360. The drive gear 363 is arranged to be engaged with the output gear 362. The driver gear 363 is supported on left and right side walls of the printer main body 312 via a bearing 364 to be fixed to a rotatable shaft 365 which extends in a horizontal direction.

Adjacently to the platen rolle325*r* of the tip of the cover 314, a platen gear 370 is integrally fixed the platen shaft 327. This platen gear 370 is arranged to be engaged with the drive gear 363 in a closed state. In other words, rotation of the drive gear 363 is accompanied by integral rotation of the platen gear 370, the platen shaft 327, and the platen roller 325.

A tip of the rolled thermal sheet 311 received in the sheet reception part 329 advances upward in a longitudinal direction between the thermal head 341 and the platen roller 325, and passes through a cutter mechanism 328 to be discharged upward in an arrow direction D.

Next, the operation of the thermal printer 310 of the embodiment will be described.

In a closed state shown in FIG. 12, the operation member 320, is pushed up by the elastic body 323 to be positioned in an upper part. At this time, the engaging pawl 330 is raised up to be set in an engaged state in which the engaging pin 319 is positioned in the engaging concave part 333. The thermal head 341 is pressed toward the platen roller 325 sandwiching the thermal sheet 311 in an upper pressing part. Accordingly, frictional forces are generated between the thermal head 341, the platen gear 325, and the thermal sheet 311. At this time, the platen gear 370 and the drive gear 363 are engaged with each other to enable power transmission.

When the motor 360 is driven in this state, the output gear of the motor 360 is rotated in, for example, an R1 direction, and with this rotation, the drive gear 363 is rotated in an R2 direction. The platen gear 370 engaged with the drive gear 363 is rotated in an R3 direction, and the platen roller 325 fixed to the platen shaft 327 is integrally rotated in the R3 direction. At this time, the thermal sheet 311 is conveyed between the platen roller 325 and the thermal head 341 by a frictional force, and printing is carried out. The sheet advances upward between the platen roller 325 and the thermal head 341.

Figure 13:
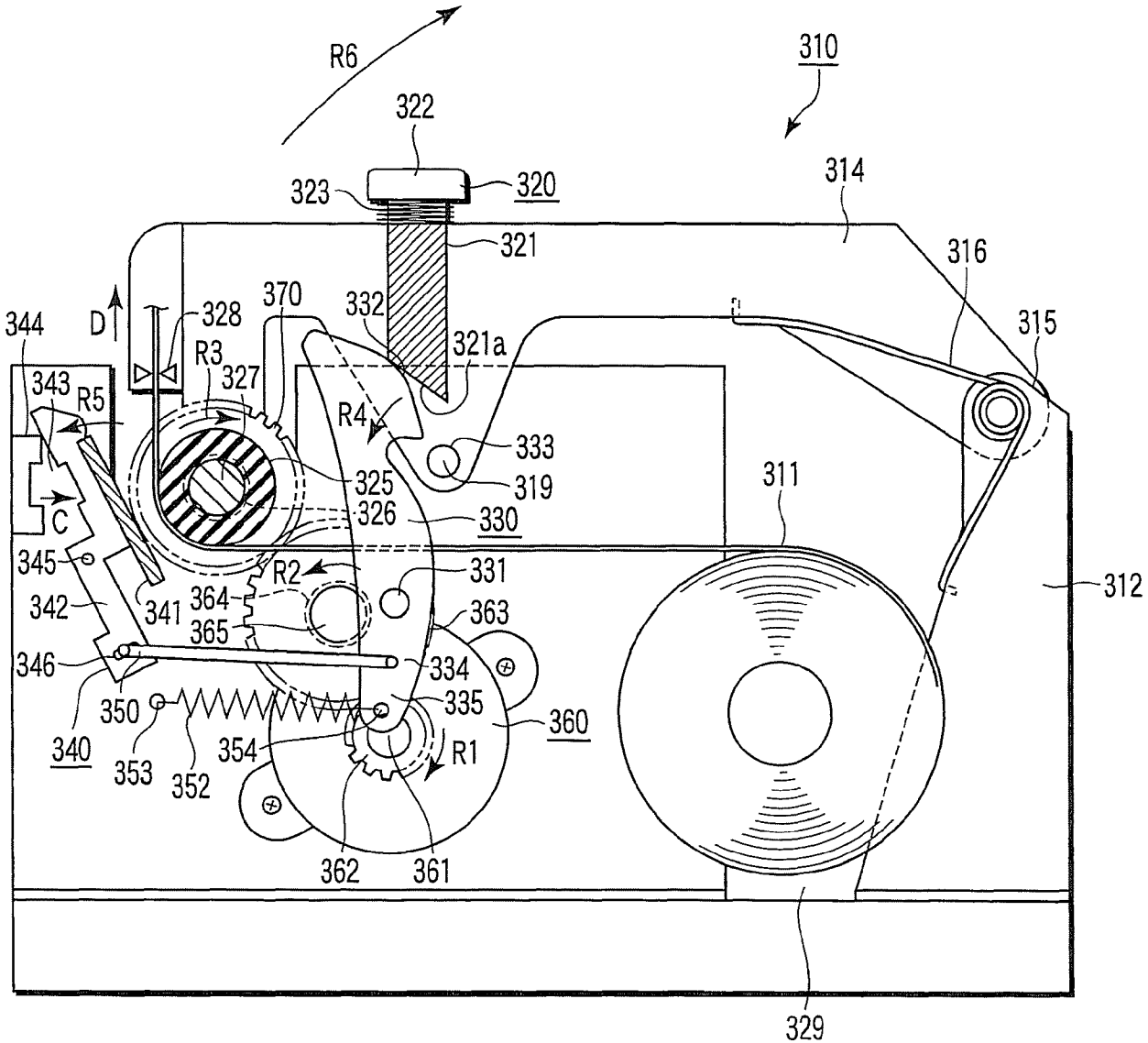
FIG. 13 is a side diagram schematically showing the inside of the thermal printer in an engagement released state.
Figure 14:
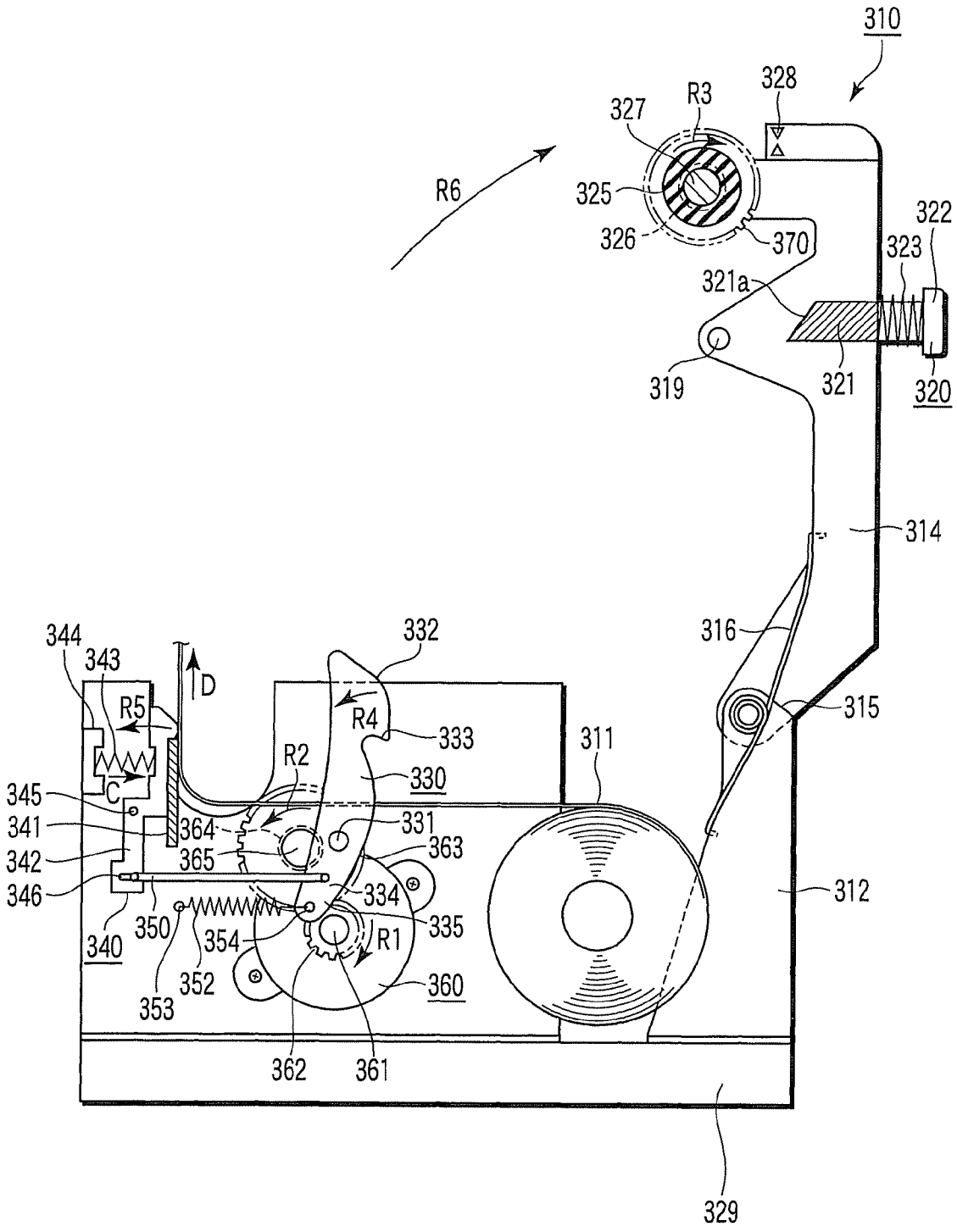
FIG. 14 is a side diagram schematically showing the inside of the thermal printer in the engagement released state.
Figure 15:
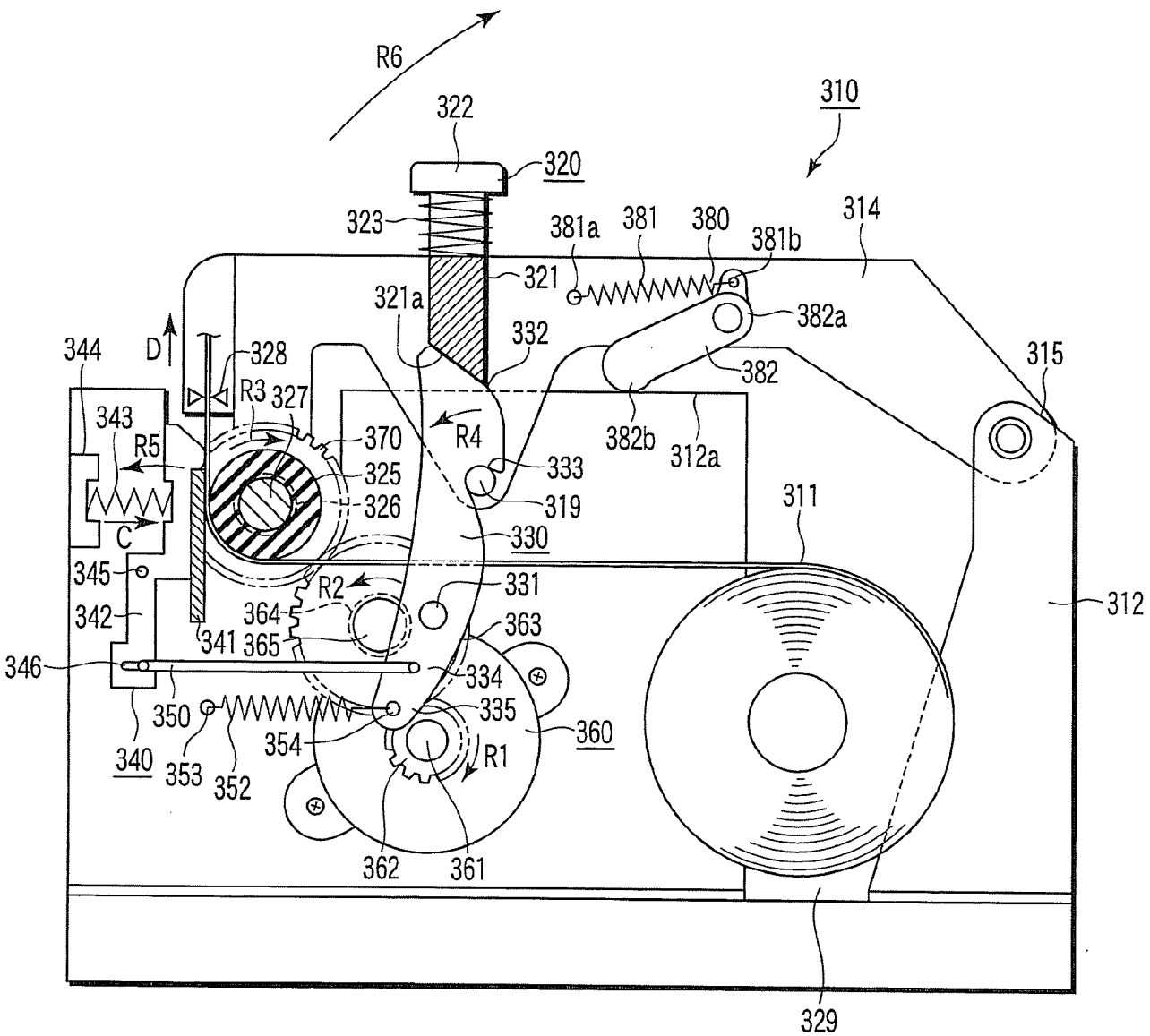
FIG. 15 is a side diagram schematically showing an internal structure of a thermal printer according to the other embodiment.

As shown in FIG. 13, when a certain or greater downward force is applied to the button part 322 of the operation part 320, the button part 322 linearly moves downward while compressing the elastic body 323. The slope 321*a* formed in the tip of the shaft part material 321 presses the slope 332 formed in the upper end of the engaging pawl 330, whereby the engaging pawl 330 is rotated in an R4 direction. With this rotation, the engaging concave part 333 moves forward to retreat from the engaging pin 319. Thus, the engaging pin 319 is removed from the engaging concave part 333 to set a released state. The rotation of the engaging pawl 330 is accompanied by pulling-backward of the linking member 350 connected to the lower part 334 of the engaging pawl 330. The elastic member 352 fixed to the lower end 335 of the engaging pawl 330 is pulled to elongate, and an elastic restoring force is generated. When the linking member 350 moves backward by a predetermined value or more defined by the clearance set in the attaching part 346, the lower end 346 of the heat sink 342 is pulled backward. Then, the heat sink 342 is rotated around the second rotary shaft 345 in an R5 direction. The thermal head 341 formed in the upper part of the heat sink 342 rotates in the R5 direction to retreat from the platen roller 325. At this time, the thermal head 341 retreats in a direction away from a moving track of the platen roller 325 which moves with opening/closing of the cover 314. Accordingly, the frictional forces of the thermal head 341 and the platen roller 325 are eliminated. As a result, the cover 314 rotates around the hinge part 315 in an R6 direction by an urging force of the twist spring 316 to be set in an opened state shown in FIG. 14. When the force of pressing the button part 322 is released after a disengaged state is set, the lower end 335 of the engaging pawl 330 is pulled by the elastic member 352, and the engaging pawl 330 is raised up. In consequence, the linking member 350 returned backward again, and the thermal head 341 is rotated in a direction reverse to R5 to return to the same posture as that of the closed state. When the cover 314 is opened, the platen roller 325 is separated from the thermal head 341, and the platen gear 370 is separated from the drive gear 363. Accordingly, the upper surface side of the printer main body 312 is opened to completely expose the thermal head 341 and the platen roller 325 to the outside. In this case, any one of the disengagement and the retreating of the thermal head 341 accompanying the rotation of the engaging pawl 330 can be operated first. However, if the thermal head 341 retreats first, it is possible to protect the platen roller 325 and the first surface which is the front of the thermal head 341.

When the cover 314 is closed, a certain or greater downward force is applied to the end of the cover 314 positioned in an upper part in the opened state to rotate the cover 314 in a direction reverse to an R6 direction. When the force application is continued after the engaging pin 319 has abutted the upper end of the engaging pawl 330, the engaging pawl 330 rotates, and the engaging pin 319 slides on the slope 332 of the upper end of the engaging pawl 330 to move. At this time, the engaging pawl 330 rotates in the R4 direction, and the thermal head 341 rotates in the R5 direction, thereby setting a retreated state from the platen roller 325. Upon reaching the position of the engaging concave part 333, the engaging pin 319 enters the engaging concave, and the engaging pin 319 stands up, thereby restoring the original posture. Accordingly, the cover 314 covers the upper surface of the printer main body 312 to set a closed state, and the engaging concave part 333 and the engaging pin 319 are engaged with each other to maintain the closed state.

The thermal printer 310 of the embodiment provides the following effects.

Because of the linking member 350 disposed to connect the lower end of the heat sink 342 to the lower end of the engaging pawl 330, it is possible to cause the thermal head 341 to retreat from the platen roller 325 during disengagement by a simple configuration. Accordingly, the frictional force which produces resistance can be eliminated. As the thermal head is removed when closed, it is possible to prevent damage caused by contact between the platen roller 325 and the first surface which is the front of the thermal head 341. In the open state, as the platen roller 325 and the thermal head 341 are separated from each other, setting of the thermal sheet 11 is facilitated. Moreover, as the platen roller 325 is disposed on the cover 314 side, and the thermal head unit 340 is disposed on the printer main body 312 side, it is possible to simplify a configuration of the cover 314 and to reduce its weight.

The inclination of the engaging pawl 330 can be regulated when no force is applied from the elongated/contracted elastic member 352. As the attaching part 346 is formed into a long hole shape, and the clearance is provided, the thermal head 341 is not moved unless a force of a predetermined value or more is applied, it is possible to stabilize printing pressure at normal time other than opening/closing time. As the twist spring 316 is disposed in the hinge part 315, the cover can be easily opened only by pressing the operation member 320. By the twist spring 316, it is possible to prevent closing of the cover 314 during sheet replacement or the like in the opened state. When the cover is closed, it is possible to promote a sure operation as certain working feelings are generated until an engaged state is set.

The present invention is not limited to the embodiment. For example, the third embodiment has been described by way of case in which the twist spring 316 is used as the urging member. However, a cam mechanism 380 shown in FIG. 15 may be used. The cam mechanism 380 as an urging member includes a spring member 381 to be elongated/contracted, and a cam part 382. One end 381*a* of the spring member 381 is fixed to the cover 314, and the other end 381*b* is connected to the cam part 382. The cam part 382 is rotatably fixed to the cover 314, and the spring member is fixed to one end 382*a*. The other end 382*b* of the cam part abuts the side upper end 312*a* of the printer main body 312 in a closed state. In this closed state, the spring member 381 is pulled by the cam part 382 to be elongated. With disengagement of the locking mechanism, one end of the cam part 382 is pulled forward by an elastic restoring force of the spring part 381. Accordingly, the cam part 382 rotates, and the other end 382*b* relatively presses the printer main body 312 to push up the cover part 314. In this case, the same effects as those of the first embodiment can be obtained.

According to the third embodiment, the operation member that makes linear motion when the button part 322 is pressed is used. However, other configurations such as a lever method can be applied.

Needless to say, various changes can be made of the components such as specific shapes of the components or the like without departing from a gist of the present invention.

Fourth Embodiment

A fourth embodiment of the present invention will be described below in detail.

Figure 16:
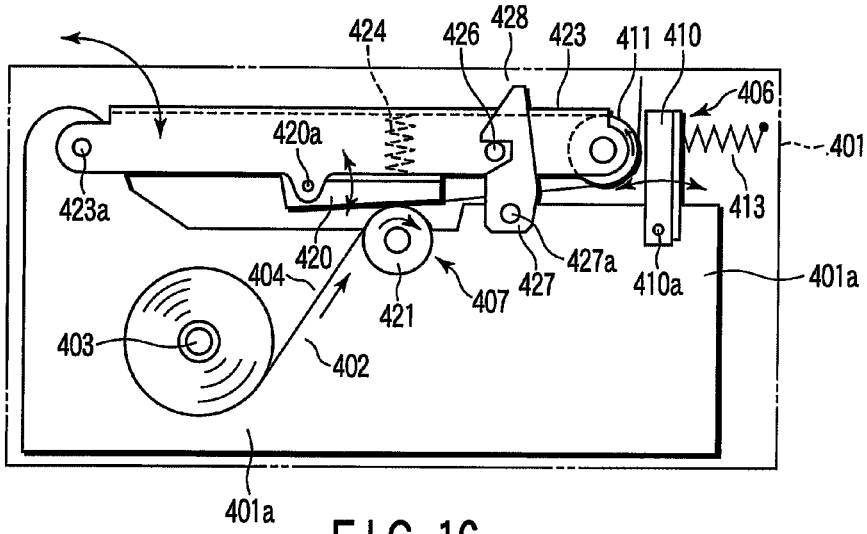
FIG. 16 is a schematic configuration diagram showing a printing device according to a fourth embodiment of the present invention.
Figure 17:
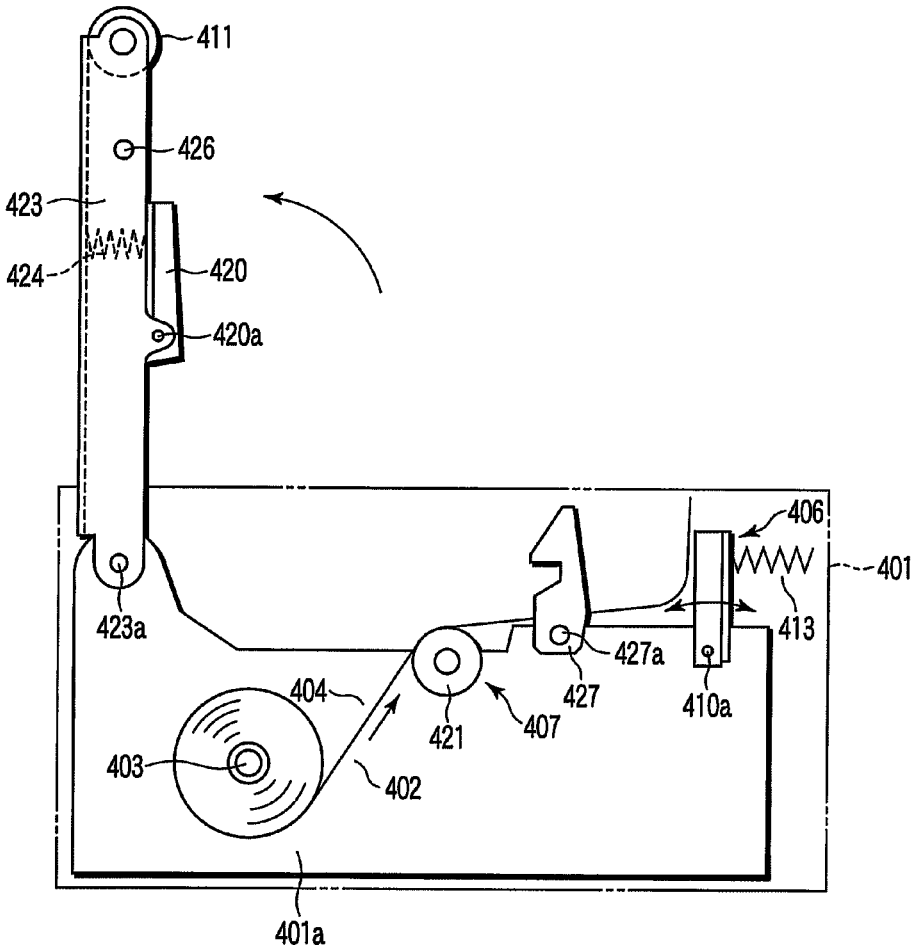
FIG. 17 is a diagram showing an opened state of an upper frame of the printing device of FIG. 16.

FIG. 16 shows a printing device according to the fourth embodiment of the present invention.

In the drawing, 401 denotes a device main body, which includes a reel part 403 for feeding a sheet 402. Both surfaces of the sheet 402 are thermosensitive printing surfaces, and the sheet is pulled out along a sheet conveying path 404.

First and second printing parts 406, 407 are arranged in the sheet conveying path 404. The first printing part 406 is positioned on a sheet conveying direction downstream side, and the second printing part 407 is positioned on a sheet conveying direction upstream side.

The first printing part 406 includes a first thermal head 410 as a first printing head, and a platen roller 411 is arranged to face the first thermal head 410 via the sheet conveying path 404. A lower side of the first thermal head 410 is rotatably supported on a main body frame 401*a* via a support shaft 410*a*, its upper side is elastically pressed by a first spring 413 as a first spring member, and a heat generation surface comes into contact with the first platen roller 411 when pressed. The first platen roller 411 is rotary-driven by a driving mechanism (not shown).

The second printing part 407 includes a second thermal head 420 as a second printing head, and a second platen roller 421 is arranged to face the second thermal head 420 via the sheet conveying path 404. The second platen roller 421 is rotatably fixed to an upper side center of the main body frame 401*a*, and rotary-driven by a driving mechanism (not shown).

The second thermal head 420 is rotatably fixed to a rough center of an upper frame 423 as an opening/closing member via a support shaft 420*a*. This second thermal head 420 is elastically pressed downward by a second spring 424 as a second spring member, and its heat generation surface comes into contact with the second platen roller 421 when pressed.

One end of the upper frame 423 is rotatably supported on the main body frame 401*a* via a support shaft 423*a*, and the first platen roller 411 is rotatably fixed to a rotational end side of the upper frame 423.

That is, the first platen roller 411 and the second thermal head 420 are fixed to the upper frame 423, and the first thermal head 410 and the second platen roller 421 are fixed to the main body frame 401*a*.

As described above, the first and second thermal heads 410, 420 are pressed to the first and second platen rollers 411, 421 by pressing forces of the first and second springs 413, 424. However, their pressing directions intersect each other. In other words, the first thermal head 410 is pressed in a direction of intersecting an opening/closing direction of the opening/closing member 423, and the second thermal head 420 is pressed in the opening/closing direction of the opening/closing member 423.

A locking pin 426 is disposed as a locking member in a side face of the upper arm 423, and a hook lever 427 as a hook member is engaged with the locking pin 426 to be disengaged. A lower part of the hook lever 427 is rotatably fixed via a support shaft 427*a*. The locking pin 426 and the hook lever 427 constitute locking means 428.

The upper frame 423 is opened by the disengagement between the locking pin 426 and the hook lever 427 through an unlocking mechanism (not shown) during replenishing of the sheet 402 or the like.

Next, a printing operation of the printing device thus configured will be described.

The sheet 402 is pulled out from the reel part 403. This sheet 402 is fed between the first and second printing parts 406 and 407 to be set between the first and second thermal heads 410, 420 and the first and second platen rollers 411, 421. From this state, the first platen roller 411 of the first printing part 406 and the platen roller 421 of the second printing part 407 are rotary-driven as indicated by an arrow by the driving mechanism (not shown). Accordingly, the sheet 402 is fed in the arrow direction, printing is executed on a first surface of the sheet 402 by the first thermal head 410, and printing is executed on a second surface of the sheet 402 by the second thermal head 420.

When the sheet 402 has been used by the printing, a new sheet 402 must be supplied.

Next, a replenishing operation of the sheet 402 will be described.

In this case, first, the operation button (not shown) is pressed to rotate the hook lever 427 clockwise around the support shaft 427*a*. By this rotation, the hook lever 427 is separated from the locking pin 426 to be unlocked. Through this unlocking, the upper frame 423 is rotated slightly upward around the support shaft 423*a* by a resisting force of the second spring 424. An operator holds a rotational end of the upper frame 424 rotated upward by hand, and rotates the upper frame 423 by about 90° to open it. After the upper frame 423 has been opened, replenishing of a sheet 402 is executed. Upon an end of replenishing of the sheet 402, the upper frame 423 is rotated downward to be closed again.

As described above, according to the embodiment, as the pressing directions of the first and second thermal heads 410, 420 to the first and second platen rollers 411, 421 intersect each other, proper head loads can be set without any influences of the first and second thermal heads 410, 420 on each other. Thus, it is possible to carry out good printing.

When the upper frame 423 is closed to engage and lock the locking pin 426 and the hook lever 427 with each other, the second thermal head 420 comes into contact with the second platen roller 421 to compress the second spring 424 when pressed, and the first platen roller 421 comes into contact with the first thermal head 410 to compress the first spring 413 when pressed.

Accordingly, up-and-down play of the locking pin 426 and the hook lever 427 can be absorbed by a resisting force of the second spring 424, and horizontal play can be absorbed by a resisting force of the first spring 413. Thus, it is possible to enhance positioning accuracy of the first and second thermal heads 410, 424 with respect to the first and second platen rollers 411, 421.

When the locking pin 426 and the hook lever 427 are unlocked from each other by releasing the disengagement, the upper frame 423 is pushed up slightly upward by the resisting force of the second spring. Thus, an upward opening operation of the upper frame 423 is facilitated.

Fifth Embodiment

Figure 18:
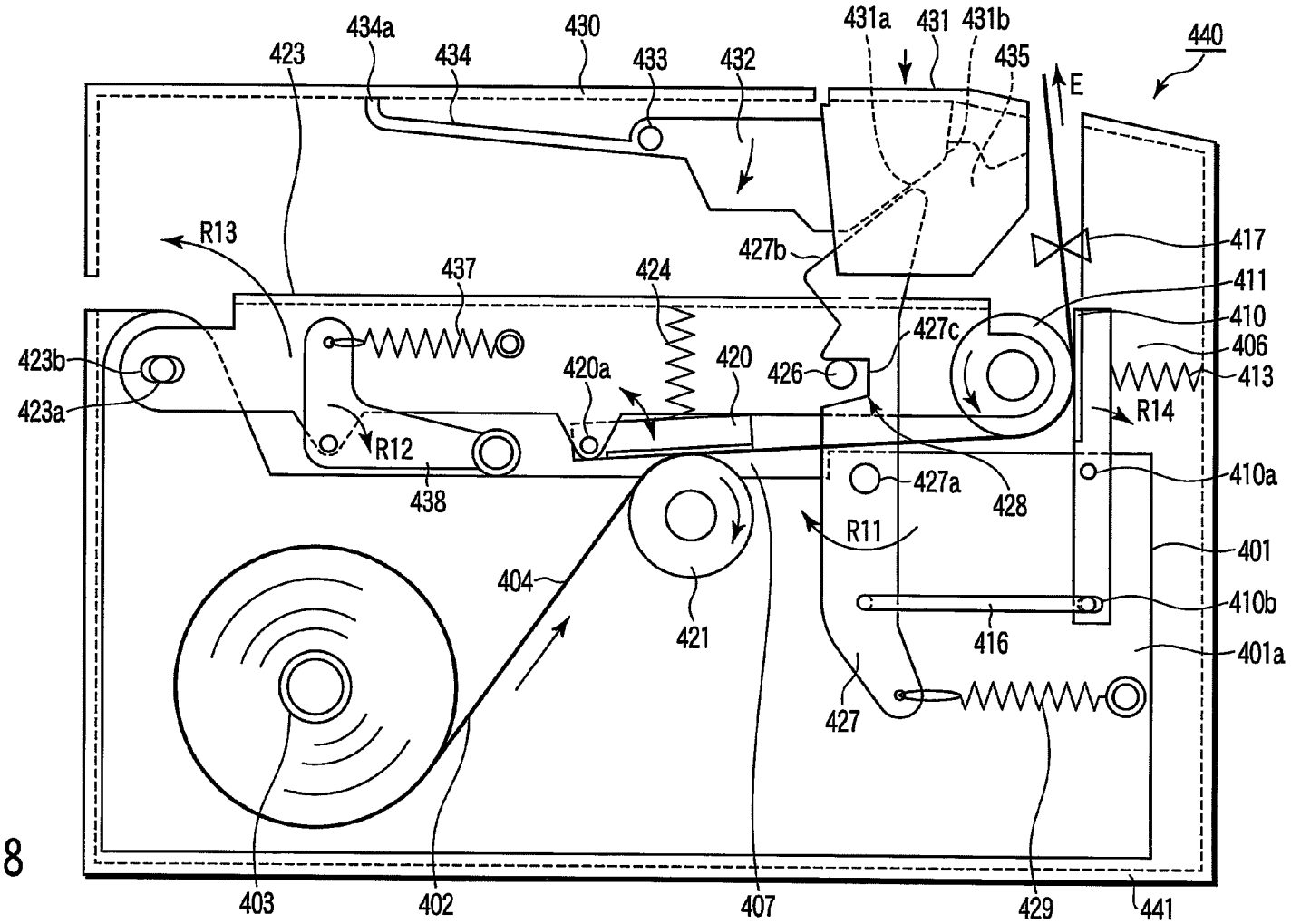
FIG. 18 is a schematic configuration diagram showing a printing device according to a fifth embodiment of the present invention.

Next, a printing device according to a fifth embodiment of the present invention will be described by referring to FIG. 18. FIG. 18 is a schematic diagram of a printing device 440 when an upper frame 423 and a cover part 430 are closed. Explanation of components similar to those of the fourth embodiment will be omitted.

The printing device 440 includes an upper frame 423, and the cover part 430 operated integrally with the upper frame 423 as a cap body for opening/closing an opening of a device main body 401. The upper frame 423 is rotatably connected to a housing 441 as a casing constituting an outer part of the device main body 401 via a support shaft 423*a*. A support hole for supporting the support shaft 423*a* has an elliptical shape in which a long axis is horizontal, and the support shaft 423*a* can move in a horizontal direction.

The cover part 430 disposed above the upper frame 423 includes a button part 431 as an unlocking mechanism, an arm 432, a support shaft body 433, and a leaf spring 434. These components are integrally constituted, and the button part 431, the support shaft part 433 and the leaf spring 434 among these are linearly arrayed.

A lower surface of the button part 431 is opened, and a concave part 435 is disposed to insert a hook lever 427. a slope 431*a* is formed in the concave part 435 to slide with respect to a slope 427*b* disposed in a tip of the hook lever 427. As it approaches the support shaft 423*a*, the slope 431*a* approaches a bottom surface of the device main body 401. A steep slope 431*b* of a larger inclination angle is formed to be continuous from an upper side of the slope 431*a*. By pressing the button part 431 downward, the slope 431*a* abuts the slope 427*b*, and the slope 427*b* is pressed. Accordingly, a tip of the hook lever 427 is moved right, and the hook lever 427 is rotated around the support shaft 427*a* in an R11 direction, whereby locking between the locking pin 426 and the hook lever 427 can be released against a pressing force of the elastic member 429.

The arm 432 is arranged in the cover part 430 to extend from a side of the button part 431 toward the support shaft 423*a*. The support shaft body 433 is connected to an end of an opposite side of the button part 431 in the arm 432. The support shaft body 433 is supported by support means (not shown) disposed in an inner surface of the cover part 430 to rotate around an axis parallel to the support shaft 423*a*.

The leaf spring 434 extends from a part of an opposite side of the arm 432 toward the support shaft 423*a* in the support shaft body 433. An abutment part 434*a* is formed in a place nearest the support shaft 423*a* to extend toward an upper wall of the cover part 430. The abutment part 434*a* always elastically abuts the upper wall of the cover part 430, and the button part 431 is always urged to the upper side by the leaf spring 434.

In a middle part of the upper arm 423, an abutment member 438 is disposed to abut the housing 441 of the device main body 401. One end of this abutment member 438 is connected to the upper frame 423 via an elongated/contracted spring member 437. By an elastic restoring force of this spring member 437, a posture of the abutment member 438 is regulated, the abutment member 438 urges the device main body 401, and the upper frame 423 is urged in its opening direction.

An upper end of the hook lever 427 can be inserted into/pulled out from the concave part 435 of the button part 431 with rotation around the support shaft 427*a* in the R11 direction. In a closed state in which the upper end of the hook lever 427, i.e., the cover part 430, closes a reception space of the device main body 401, a slope 427*b* pressed by the slope 431*a* of the button part 431 is formed in a place facing the cover part. As in the case of the slope 431*a*, the slope 427*b* is inclined to approach the bottom wall of the device main body 401 as it approaches the support shaft 423*a*. The slope 427*b* is formed to slide with respect to the slope 431*a* of the concave part 435 of the button part 431. An engaging concave part 427*c* is formed in an upper part of the hook lever 427 to be engaged with the locking pin 426.

One end of a linking member 416 as an example of a linking member is fixed to an opposite side around the support shaft 427*a* of the hook lever 427, i.e., a lower part, of the engaging concave part 427*c*. The other end of the linking member 416 is rotatably fixed with a clearance via a long-hole shaped attaching part 410*b* firmed in an end lower than the support shaft 410*a* of the thirst thermal head 410. In other words, the first thermal head 410 and the hook lever 427 are connected to each other by the rodlike linking member 416. Through this clearance, as the hook lever 427 is not rotated unless a certain or greater force is applied to the button part 431, constant printing pressure is secured at normal time.

One end of the elastic member 429 is fixed to a lower end of the hook lever 427. For example, the elastic member 429 includes an elongated/contracted spring member. The other end of the elastic member 429 is connected to housing 441 of the device main body 401. When the button part 431 is pressed by a certain or greater force, the hook lever 427 is inclined in an R1 direction, and the elastic member 429 is elongated. The elastic member 429 is contracted when the pressing force applied to the button part 431 is removed. By pulling the lower end of the hook lever 427 by its elastic restoring force, inclination of the hook lever 427 is regulated in a direction of locking the locking pin 426 with the engaging concave part 427*c*, i.e., a direction the reverse of R11.

A cutter mechanism 417 is disposed to cut a sheet 402 above the platen roller 411 in a closed state. A tip of the sheet 402 advances upward in a longitudinal direction between the first thermal head 410 and the first platen roller 411, and passes through the cutter mechanism 417 to be discharged upward in an arrow direction B.

In the printing device 440 thus configured, the sheet 402 is replaced as follows. That is, when the button part 431 is pressed downward, the slope 431*a* of the concave part 435 presses the slope 427*b* of the hook lever 427. As the slopes 431*a* and 427*b* are inclined, they slide together with downward motion of the button part 431 to move the upper end of the hook lever 427 to the right (shown) and to rotate the hook lever 427 around the support shaft 427*a* in the R11 direction. Accordingly, the locking between the locking pin 426 and the engaging concave part 427*c* is released.

After the hook lever 427 and the locking pin 426 are disengaged from each other, the abutment member 438 is rotated in an R12 direction by a pressing force of the spring member 437, whereby the upper frame 423 is rotated around the support shaft 423*a* in an R13 direction to slightly raise a tip of the upper frame 423.

At this time, the button part 431 is still pressed by a finger of a user. Thus, while the upper frame 423 is slightly opened, and the locking pin 426 is slightly raised, positions of the button part 431 and the hook lever 427 are not changed. The locking pin 426 moves to a position higher than the engaging concave part 427*c* of the hook lever 427. Accordingly, even when pressing of the button part 431 is released, the locking pin 426 and the hook lever 427 are not engaged with each other again. In this state, the slope 427*b* of the hook lever 427 presses the slope 431*a* of the concave part 435 to the left side (shown). The entire upper frame 423 is urged to the left side (shown). Thus, as the support hole 423*b* is elliptical, the support shaft 423*a* of the upper frame 423 is moved in a left direction.

The R11-direction rotation of the hook lever 427 is accompanied by pulling of the elastic member 429 fixed to the lower end of the hook lever 427, and the elastic member is elongated to generate an elastic restoring force. The rotation of the hook lever 427 is accompanied by pulling of the linking member 416 to the left side (shown). When the linking member 416 is moved by a predetermined value or more defined by the clearance set in the attaching pat 410*b*, the lower end of the first thermal head 410 is pulled to the left side (shown). Then the first thermal head 410 rotates around the support shaft 410*a* in an R14 direction. At this time, the first thermal head 410 retreats in a direction away from a moving track of the platen roller 411 moved with opening/closing of the upper frame 423. Thus, a frictional force between the thermal head 410 and the platen roller 411 is eliminated.

After the pressing of the button part 431 has been released, the cover part 430 and the upper frame 423 are greatly rotated in the R13 direction to set an open state. After the pressing of the button part 431 has been released, the button part 431 is rotated around the support shaft body 433 by urging from the leaf spring 434, and returns to its-original position with respect to the cover part 430.

Upon releasing of the force of pressing the button part 431, the lower end of the hook lever 427 is pulled to the left side (shown) by an elastic restoring force of the elastic member 429, and the hook lever 427 stands up. In consequence, the linking member 416 returns again to the right side (shown), and the first thermal head 410 is rotated in a direction reverse to an R14 direction to return to the same posture as that in the closed state.

After replacement of the sheet 402, when the cover part 430 is pressed to rotate in a direction reverse to the R13 direction, the abutment member 438 first abuts the device main body 401, and the spring member 437 is slowly elongated to slowly close the upper frame 423. Additionally, when the upper frame 423 is pressed in a closing direction, the engaging pin 426 abuts the engaging concave part 427*c* to be guided. Then, the locking pin 426 and the hook lever 427 are engaged with each other, and the platen roller 411 abuts the thermal head 410.

The printing device of the embodiment provides the same effects as those of the fourth embodiment. When the sheet 402 is replaced, the cover part 430 can be opened/closed only by a simple operation of pressing the button part 431, and interference of the platen roller 411 with the other members can be prevented. By retreating the thermal head 410 from the platen roller 411 during the opening/closing operation, friction therebetween can be prevented, the opening/closing operation can be facilitated, and damage of the members can be prevented. By the elongated/contracted elastic member 429, it is possible to regulate inclination of the hook lever 427 when no force is applied. As the attaching part 410*b* is formed into the long hole shape, and the clearance is set, the thermal head 410 is not moved unless a force of a predetermined value or more is applied. Thus, it is possible to stabilize printing pressure at normal time other than the opening/closing time.

As the leaf spring 434 is used for returning the button part 431 pressed by the user to its original position, a reception space as large as the conventional coil spring is unnecessary, and thus the thermal printer is made compact. The button part 431, the support shaft body 433, and the abutment part 434*a* of the leaf spring 434 are linearly arranged. Accordingly, even when a large force is applied to the button part 431, it is possible to prevent twisting of the opening/closing member and inclination of the button part 431.

The present invention is not limited to the above embodiments. The components can be changed to be embodied without departing from its gist at an implementation stage. Various inventions can be formed based on a proper combination of the plurality of components disclosed in the embodiment. For example, some may be removed from all the components of the embodiment, or the components of the different embodiments may be properly combined.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the invention as defined by the appended claims and their equivalents thereof.

What is claimed is:

1. A printing device comprising:

a device main body coupled to a cover, wherein the device main body and the cover comprise a locking means that facilitates the locking and unlocking of the, device main body and the cover, wherein the locking means comprises a release button disposed in the cover, a locking member disposed in the cover and a hook member disposed in the device main body, wherein when the thermal printer is closed, the locking member and the hook member are engaged and, upon pressure applied to the release button, the locking member and the hook member disengage such that the cover is capable of rotating away from the device main body, wherein the release button is attached to the cover in a manner that allows for rotation of the release button in a direction opposite to the direction of rotation of the cover;

a first printing head to print first surface sides of a sheet, a first platen, a second printing head to print second surface sides of the sheet and a second platen which are arranged to face each other via a sheet conveying path in the device main body to open the thermal printer, wherein movement of a button of the cover causes the locking member and the hook member to separate; and first and second spring members which elastically press the first and second printing heads to the first and second platens;

wherein the first platen and second printing head are fixed to the cover, and the first printing head and the second platen are fixed to the device main body side, and wherein the first and second printing heads are arranged so that pressing directions of the first and second platens intersect each other.

2. The printing device according to claim 1, wherein the locking means locks the cover when the cover is closed.

3. The printing device according to claim 1, wherein the hook member is engaged with the locking member when the cover is closed and disengaged when the cover rotates away from the printer main body.

4. The printing device according to claim 1, wherein the first and second spring members are compressed against pressing forces when the cover is locked.

* * * * *